US005201130A

United States Patent [19]

Krchnak

[11] Patent Number: 5,201,130

[45] Date of Patent: Apr. 13, 1993

[54] TILE TEMPLATE

[76] Inventor: Peter S. Krchnak, P.O. Box 30934, Bethesda, Md. 20814

[21] Appl. No.: 825,126

[22] Filed: Jan. 24, 1992

[51] Int. Cl.[5] ..... G01B 3/30

[52] U.S. Cl. ..... 33/526; 33/645; 33/DIG. 20; 33/613

[58] Field of Search ..... 33/526, 527, DIG. 20, 33/613, 645

[56] References Cited

U.S. PATENT DOCUMENTS

| | | | |
|---|---|---|---|
| 2,930,135 | 3/1960 | Rodtz | 33/DIG. 20 |
| 4,953,341 | 9/1990 | Joos | 33/DIG. 20 |
| 4,955,142 | 9/1990 | Rieck | 33/526 |

*Primary Examiner*—Harry N. Haroian
*Attorney, Agent, or Firm*—Mason, Fenwick & Lawrence

[57] ABSTRACT

A tile template comprises first and second opposed arms and third and fourth opposed arms disposed at right angles to the first and second opposed arms, the first and second arms having substantially equal lengths; and the third arm having a length of approximately ½ inch and being relatively short in comparison to the first, second, and fourth arms. The first and second arms define a straight edge having a middle, wherein the third and fourth arms are disposed opposite each other at the middle of the straight edge. Each of the arms has a top portion and a bottom portion, the top portions all having a first width, the bottom portions all having a second width, and the first width being greater than the second width. The arms are of uniform, equal height, without projections or indentations; and each of the arms has substantially planar top and bottom surfaces, the top surfaces being coplanar with each other and the bottom surfaces being coplanar with each other.

5 Claims, 1 Drawing Sheet

TILE TEMPLATE

BACKGROUND OF THE INVENTION

1. Field of the Invention

The present invention is a tool which facilitates the laying of marble, ceramic and any other tile that requires a joint in order to place it onto a surface. During installation of the tiles, it is necessary that the tiles be positioned in a straight row to create the desired pattern. Any deviation in the positioning of a tile effects the evenness of a row and distracts from the overall look. Pattern uniformity is achieved by controlling the spacing between individual tiles when the tiles are set in the adhesive used to secure them to the underlying surface.

2. Related Art

Currently in order to provide proper tile spacing, the joint size is determined by a measure and chalk lines which require lines to be drawn for each row of tiles. This procedure also requires more than one person to lay the tiles.

It can be appreciated that there is a need for a tool which could provide spacing of a universal thickness and a straight edge to ensure even positioning. If properly used the Tile Template permits a large quantity of tiles to be laid in a short period of time with all of the tiles appropriately aligned with respect to each other.

SUMMARY OF THE INVENTION

The present invention is constructed to form a four-armed tool. A first pair of opposed arms create a straight edge and maintains the particular joint size. A third arm is in the middle of this edge and at right angles to it. It acts as the spacer. The remaining arm is opposite the third arm, and determines the placement of subsequent tiles and the joint size. After two tiles are placed in this manner, the instrument is removed and replaced on the other side of the tiles already laid on the surface to provide a guide for the next ones and so on. This method provides a simple, fast, and efficient way to lay tile.

DESCRIPTION OF THE DRAWINGS

The invention's specific features will be better understood with reference to the drawings included.

FIG. 1 is a top plan view of a tile template in accordance with the present invention, showing the four arms and.

DETAILED DESCRIPTION

Figure 1:
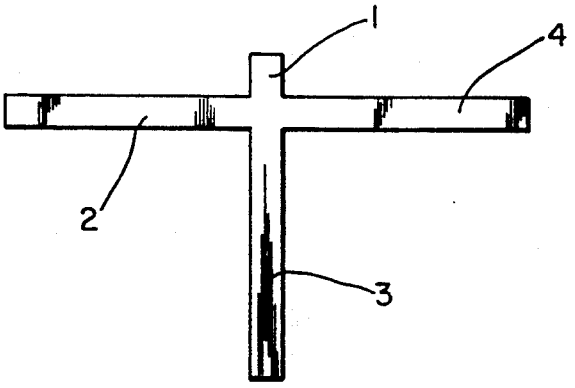

Referring to the drawings there is shown in FIG. 1 a four-armed template with first and second opposed arms 11 and 13, and third and fourth opposed arms 12 and 14 disposed at right angles to arms 11 and 13. Arms 11 and 13 define a straight edge, and arms 12 and 14 are disposed opposite each other at the middle of this edge. Arms 11–14 can be of different lengths, and the width of the top and bottom of each of arms 11–14 has a top and bottom part which can be made in different sizes of ⅛" to ¾". The structure of the template 10 and use of the template 10 to install tile and to select different joint sizes will now be described. Once the surface to be tiled has been applied with a layer of adhesive and the starting tiles set onto it with a joint between them, the tile template 10 can now be used. As shown in FIG. 1, Arm 11 is ½" in length and has a top portion 11*a* which is wider than its bottom portion 11*b*, and in which top and bottom portions 11*a* and 11*b* can vary in width from ⅛" to ¾". Arm 11 fits into the space between the tile already on the surface. Its varying size affords optional joint sizes. This is desirable because it allows the tile template 10 to accommodate different joint sizes since the user's needs will vary.

Figure 2:
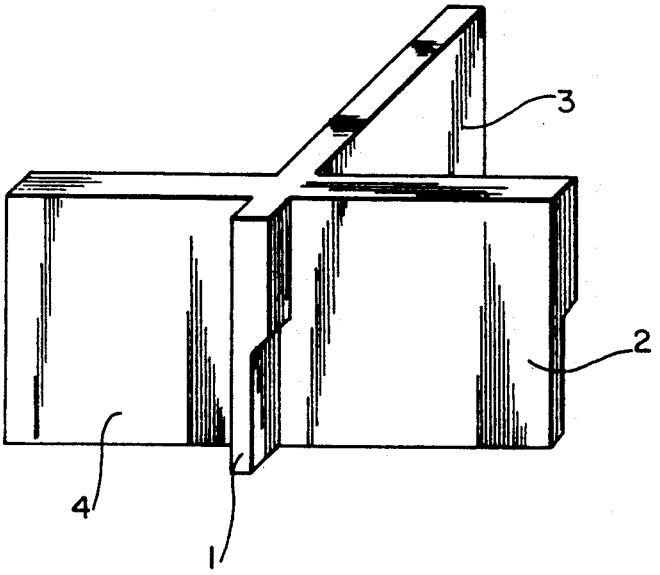
FIG. 2 is a front perspective view of the tile template of FIG. 1.
Figure 3:
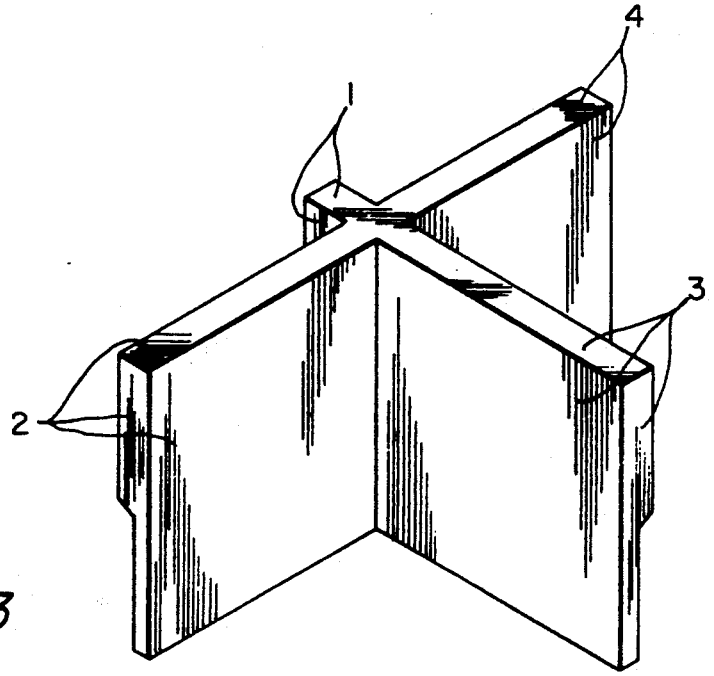
FIG. 3 is a back perspective view showing the tile template of FIG. 1

Referring to FIG. 2 arms 12 and 14 fit against the edges of the tile already on the surface. They provides a straight edge while maintaining the proper joint size. Arms 12 and 14 can each vary in length from 2 ½ inches to 9 inches. Further, arms 12 and 14 have respective top portions 12*a* and 14*a*, which are wider than their respective bottom portions 12*b* and 14*b*, top portions 12*a* and 14*a* and bottom portions 12*b* and 14*b* varying in width from ⅛ inch to ¾ inch. Once the tile template 10 is placed as described, the two tiles to be laid are fit into the two spaces provided by arm 13. The length of arm 13 can vary from 2 ½ inches to 9 inches. The width of the top and bottom portions 13*a* and 13*b* of arm 13 also varies from ⅛ inch to ¾ inch to maintain proper joint size. The tile template 10 can then be removed and used to space the next two tiles and so on. It eliminates the need to measure and chalk each new row of tile to be laid.

Arms 11–14 are all the same, uniform height, and the top and bottom surfaces of arms 11–14 are substantially planar, so that template 10 can be placed with either the top portions 11*a*–14*a* or the bottom portions 11*b*–14*b* of arms 11–14 against the surface being tiled.

The tile template 10 could be made from steel or fiberglass. The varying width of the top and bottom portions of the arms 11–14 of template 10 can produce a range of joint spaces of different thicknesses. It should be understood that thicknesses other than the ones featured may be used in accordance with this invention. It is therefore understood that several modifications could be made to the length and width of the template without departing from the spirit and scope of the present invention as defined by the claims.

I claim:

1. A tile-laying template comprising:

first and second opposed arms having substantially equal lengths; and third and fourth opposed arms disposed at right angles to said first and second opposed arms;

said third arm being relatively short in comparison to said first, second, and fourth arms; and each of said arms having a top portion and a bottom portion, said top portions all having a first width, said bottom portions all having a second width, and said first width being greater than said second width.

2. A tile-laying template comprising:

first and second opposed arms; and third and fourth opposed arms disposed at right angles to said first and second opposed arms;

each of said arms having a top portion and a bottom portion, said top portions all having a first width, said bottom portions all having a second width, and said first width being greater than said second width;

said arms being of uniform, equal height;

each of said arms having planar top and bottom surfaces, without projections or indentations; and said top surfaces being coplanar with each other; and said bottom surfaces being coplanar with each other.

3. The template of claim 2, wherein said first and second arms define a straight edge having a middle, and wherein said third and fourth arms are disposed opposite each other at said middle of said straight edge.

4. The template of claim 3, wherein said third arm is shorter than at least said first and second arms.

5. The template of claim 2, wherein said first and second arms are of equal length, and wherein said third arm has a length less than that of said first, second, and fourth arms.

* * * * *